US012805625B2

(12) United States Patent
Barbarino et al.

(10) Patent No.: US 12,805,625 B2
(45) Date of Patent: Nov. 24, 2026

(54) FORMULA CONTAINER WITH SECONDARY DEGASSING VALVE

(71) Applicant: L'OREAL, Paris (FR)

(72) Inventors: Casey Barbarino, San Anselmo, CA (US); John Boland, San Francisco, CA (US)

(73) Assignee: L'OREAL, Paris (FR)

( * ) Notice: Subject to any disclaimer, the term of this patent is extended or adjusted under 35 U.S.C. 154(b) by 191 days.

(21) Appl. No.: 18/928,566

(22) Filed: Oct. 28, 2024

(65) Prior Publication Data

US 2026/0114584 A1 Apr. 30, 2026

(51) Int. Cl.
*A45D 34/00* (2006.01)

(52) U.S. Cl.
CPC ..... *A45D 34/00* (2013.01); *A45D 2034/002* (2013.01); *A45D 2034/005* (2013.01); *A45D 2200/054* (2013.01)

(58) Field of Classification Search
CPC ..... A45D 34/00; A45D 2034/002; A45D 2034/005; A45D 2200/054
See application file for complete search history.

(56) References Cited

U.S. PATENT DOCUMENTS

2009/0008415 A1* 1/2009 Ohshima ..... B05B 11/1011 222/383.1
2011/0284579 A1* 11/2011 Pardes ..... A61F 9/0008 222/207
2019/0080480 A1* 3/2019 Nichol ..... A45D 44/005
2021/0196021 A1* 7/2021 Levi ..... B65D 75/5872
2022/0382241 A1* 12/2022 Kang ..... G05B 19/188
2024/0172858 A1 5/2024 Jablonski et al.

FOREIGN PATENT DOCUMENTS

WO 2019/067336 A2 4/2019

* cited by examiner

*Primary Examiner* — Jeremy Carroll
(74) *Attorney, Agent, or Firm* — CHRISTENSEN O'CONNOR JOHNSON KINDNESS PLLC

(57) ABSTRACT

A formula container assembly with a secondary valve degassing component. A formula container assembly includes a formula container comprising a container chamber and a container outlet; a primary valve comprising a primary valve inlet and a primary valve outlet; and a secondary valve comprising a secondary valve inlet and a secondary valve outlet, wherein the primary valve inlet and the secondary valve inlet are in fluid communication with the container chamber.

13 Claims, 10 Drawing Sheets

FORMULA CONTAINER WITH SECONDARY DEGASSING VALVE

FIELD OF THE DISCLOSURE

The present application relates to material storage containers. In an embodiment, the material storage container contains a cosmetic formula and may be in the form of a formula container. In this embodiment or others, the material storage container contains a primary valve for dispensing the material stored in the container and a secondary or purge valve for purging gas from the material storage container, such as that resulting from off-gassing from a cosmetic. The present disclosure also relates to formula container assemblies with secondary degassing valve components.

SUMMARY

The following summary of the present disclosure is intended to introduce different concepts in a simplified form that are described in further detail in the detailed description provided below. This summary is neither intended to denote essential features of the present disclosure nor shall this summary be used as an aid in determining the scope the claim subject matter.

Aspects of the present disclosure relate to formula container assemblies with secondary degassing valve components. In an embodiment, the formula container assembly including: a formula container comprising a container chamber and a container outlet; a primary valve comprising a primary valve inlet and a primary valve outlet; and a secondary valve comprising a secondary valve inlet and a secondary valve outlet, wherein the primary valve inlet and the secondary valve inlet are in fluid communication with the container chamber.

In an embodiment, the formula container is a flexible formula packet. The container chamber includes a formula fluid, the formula fluid including a liquid formula fluid and a gaseous formula fluid. In embodiments, the formula fluid off-gasses the gaseous formula fluid.

In an embodiment, the formula container assembly includes a valve assembly, the valve assembly comprising the primary valve and the secondary valve. In embodiments, the formula container assembly includes a container gripping insert configured to nest in the container outlet and receive the valve assembly.

In an embodiment, the formula container assembly includes a primary flow channel with a primary flow inlet and a secondary flow channel with a secondary flow inlet. In embodiments, the primary flow inlet and the secondary flow inlet are both coterminal with an interior portion of the container gripping insert. In an embodiment, the inner diameter of the primary flow channel is greater than an inner diameter of the secondary flow channel.

In an embodiment, the secondary valve is configured to open (i.e., permit fluid flow from the secondary valve inlet to the secondary valve outlet) when a fluid pressure in the secondary valve inlet relative to an exterior air pressure exceeds a cracking pressure. For example, when pressure is applied to the formula container, the fluid pressure in the secondary flow channel increases and opens the secondary valve, thereby allowing the gaseous formula fluid to be purged from the formula container through the secondary valve outlet.

In embodiments, the cracking pressure exceeds a latent liquid formula fluid pressure when the formula container assembly is held upside down, thereby preventing the leakage of formula from the formula container assembly.

In embodiments, the cracking pressure is in a range of about 0.2 psi to about 5 psi. In embodiments, the secondary valve is an umbrella valve.

In embodiments, the formula container assembly includes a protective cap configured to removably seal an exterior of the secondary valve outlet.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

TABLE 1

Figure 1A:
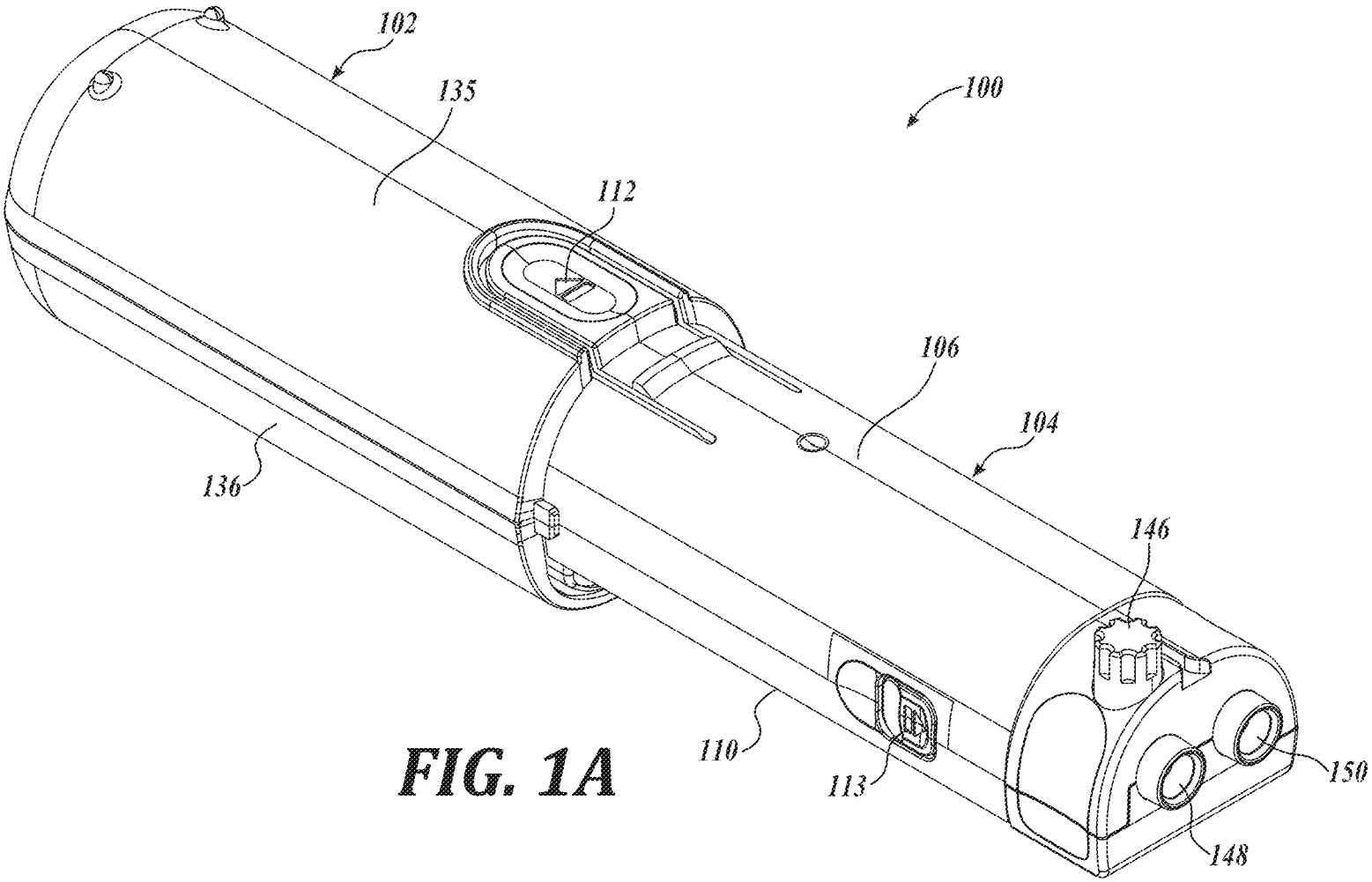
FIG. 1A is a front perspective view of an example of a formulation cartridge according to one or more aspects of the present disclosure.

| Listing of Drawing Elements |
|---|
| 100 formulation cartridge |
| 102 handle portion |
| 104 refill unit |
| 106 tray portion |
| 110 front body portion |
| 112 cartridge release |
| 113 cartridge release |
| 114 first formula packet |
| 116 second formula packet |
| 118 first formula fluid |
| 120 second formula fluid |
| 123 primary valve |
| 124 secondary valve |
| 125 tertiary valve |
| 126 shell |
| 128 rear body portion |
| 132 valve frame |
| 135 first half |
| 136 second half |
| 138 encryption chip |
| 140 valve engagement unit |
| 142 engagement members |
| 144 coupling tab |
| 146 protective cap |
| 148 primary valve nozzle |

TABLE 1-continued

| Listing of Drawing Elements |
|---|
| 150 tertiary valve nozzle |
| 402 primary valve inlet |
| 404 primary valve outlet |
| 406 secondary valve inlet |
| 408 secondary valve outlet |
| 410 formula packet |
| 412 packet chamber |
| 414 packet outlet |
| 416 valve assembly |
| 418 container gripping insert |
| 420 primary flow channel |
| 422 secondary flow channel |
| 600 formula packet assembly |
| 800 formulation cartridge |
| 802 handle portion |
| 804 refill unit |
| 806 tray portion |
| 810 front body portion |
| 812 cartridge release |
| 813 cartridge release |
| 823 primary valve |
| 824 secondary valve |
| 825 tertiary valve |
| 835 first half |
| 836 second half |
| 848 primary valve nozzle |
| 850 tertiary valve nozzle |

DETAILED DESCRIPTION

The detailed description set forth below in connection with the appended drawings, where like numerals reference like elements, is intended as a description of various embodiments of the disclosed subject matter and is not intended to represent the only embodiments. Embodiments described in this disclosure are provided merely as examples or illustrations and should not necessarily be construed as preferred or advantageous over other embodiments. The illustrative examples provided herein are not intended to be exhaustive or to limit the claimed subject matter to the precise forms disclosed.

Embodiments of the present disclosure relate generally to a formulation container assembly. Fluid containers, such as pouches, packets, etc., are a convenient means for transporting fluids through commercial supply chains, and for storing fluids for use in various appliances. These fluid containers can include, for example, fluid packets such as formulation packets used in the cosmetic industry, ink packets used in the printing industry, liquid food additives used in the food processing and production industry, and the like.

A manufacturer can fill a fluid container, such a fluid packet, with a desired fluid, and then such a packet can be subsequently distributed to an end user. Once the end user receives the fluid packet, it can be installed in an appliance to access the fluids inside, and when the end user has used the contents of the fluid packet, the fluid packet can be disposed of or returned to the manufacturer or a re-manufacturer for refilling. An advantage of this arrangement is that the end user can reuse an appliance portion many times, treating the fluids inside as a consumable element of a broader system.

Because fluid containers, such as fluid packets, are sealed off against the external environment during transportation, fluid containers, such as fluid packets, can prevent messy spills or loss of a deliverable fluid. Additionally, such a sealing-off from the environment can prevent degradation of the fluid, such as may occur due to oxidation with atmospheric oxygen, or the evaporation or loss of volatile fluids over time.

While many fluids can thus be preserved against external degradation for use by the end user in such a sealed configuration, there are many fluids that undergo auto-degradation within a sealed fluid container, such as a sealed fluid packet, for example, some fluids undergo off-gassing or decomposition reactions over time, even in the absence of contact with an external environment. In such cases, these undesired side reactions can result in the buildup of gasses inside the fluid container, thus requiring the user to first purge excess gas from the fluid container before the liquid fluid can be effectively accessed. This can result in frustration for the user who must engage in a lengthy priming process before the fluid container can be effectively used and can complicate the use of fluid containers when coupled with particular appliances, such as peristaltic pumps, etc., which do not function properly when exposed to mixtures of gas and liquid.

Accordingly, there is a need for improved devices that enable quick, easy, and clean purging of fluid containers, such as fluid packets, containing liquids that undergo off-gassing. Embodiments of the present disclosure address these or other long-felt and unmet needs in the art.

The present disclosure provides examples of a formulation container assembly, such as one suitable for use with a formulation cartridge 100 or formulation cartridge 600 (described further herein with respect to FIGS. 1A, 1B, 2, and 6). However, it is to be understood that any of the formulation container assemblies disclosed herein can contain any type of non-gaseous fluid and can be used in any type of appliance, such as in a device useful in the industries identified above.

Referring initially to FIGS. 1A-3, an embodiment of a formulation cartridge 100 is depicted. The formulation cartridge 100 is an example of a formulation cartridge type which is compatible with any of the formulation delivery systems, formulation delivery devices, and formulation product lines described in detail in U.S. patent application Ser. No. 18/060,258, published May 30, 2024, and assigned to L'Oreal, the disclosure of which is incorporated by reference herein in its entirety for all purposes.

Figure 1B:
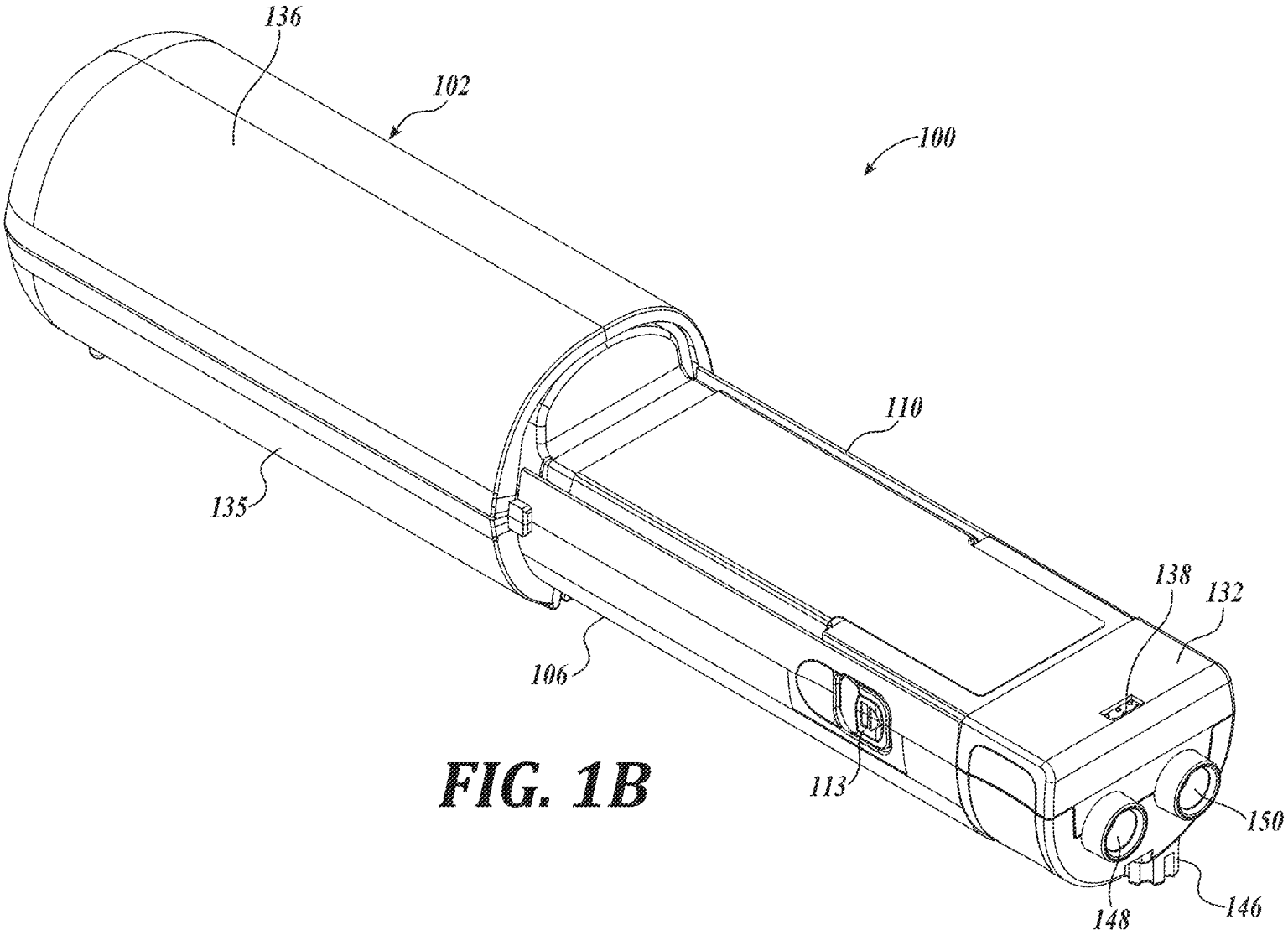
FIG. 1B is a rear perspective view of the formulation cartridge of FIG. 1A.

FIGS. 1A and 1B are front and rear perspective view illustrations, respectively, of formulation cartridge 100. Formulation cartridge 100 is a sustainable embodiment specifically designed to reduce waste and environmental impact, while delivering a user-friendly experience. To that end, formulation cartridge 100 includes two main components: a handle portion 102 and a disposable formulation cartridge refill unit 104 (hereinafter referred to simply as "refill unit 104") configured to reversibly slide into the handle portion 102. Historically, known cartridges were designed to be entirely disposed of after depletion of the formulation stored therein, leading to significant waste and higher consumer cost.

In contrast to known cartridges, the formulation cartridge 100 is constructed such that the handle portion 102 can be reused indefinitely and the refill unit 104 can be readily replaced after depletion of the formulation stored therein. Further still, refill unit 104 can be configured to be deconstructed into smaller components, some of which can be recycled in some embodiments, and others disposed of. Thus, the formulation cartridge 100 utilizes an innovative structure to reduce waste and improve the user experience.

Handle portion 102 is sized, dimensioned, and constructed to be repeatedly inserted into the cartridge cavity of a formulation delivery device. Accordingly, handle portion 102 is formed of ABS plastic or similar rigid polymer or other material and includes a hollow handle portion 102 configured to receive the refill unit 104 therein, and a tray portion 106 that extends away from handle portion 102. Handle portion 102 is a two-piece assembly in the representative embodiment shown (although it may be one-piece in other embodiments) and is sized and dimensioned such that it forms a seamless extension of the formulation delivery device handle when fully inserted into a cartridge cavity thereof. Tray portion 106 projects away from handle portion 102 and has a U-shape configured to support the refill unit 104 (e.g., the front body portion 110). To facilitate secure engagement and easy removal, handle portion 102 includes coupling means for coupling the formulation cartridge 100 to a reusable handle of a formulation delivery device. Representative coupling means include a cartridge release 112 (e.g., a latch) formed in the handle portion 102, which engages the formulation delivery device upon proper and complete insertion, and cartridge release 113 (e.g., a latch) formed in valve frame 132.

Thus, the configuration of the formulation cartridge 100 enables a consumer to utilize many different formulations in a single formulation delivery device. A representative formulation cartridge 100 is described below.

In a representative embodiment, the formulation product line includes a hair coloring formulation and a scalp treatment formulation. In other representative embodiments, the formulation product line comprises at least two, three, four, five, six, seven, or eight of the following different formulations, each of which is stored within the same formulation cartridge type: a permanent hair dye and a developer; a semi-permanent hair dye and a developer; a shampoo; a conditioner; a hair growth treatment such as minoxidil; a hair protein treatment; a disulfide bond repairing hair treatment; or a fluid scalp treatment. In another representative embodiment, the formulation product line includes any of the above combinations, in addition to an optional cleaning cartridge of the same formulation cartridge 100 type. In one or more embodiments, the developer is chosen from peroxides, persulfates, perborates, percarbonates, alkali metal bromates, ferricyanides, peroxygenated salts, or a mixture thereof. In an embodiment, the developer is includes at least one redox enzyme such as laccases, peroxidases, and 2-electron oxidoreductases, such as uricase, where appropriate in the presence of their respective donor or co-factor. Oxygen in the air may also be an oxidizing component.

In a certain embodiment, the developer is hydrogen peroxide. In various embodiments, the hydrogen peroxide may be present in an aqueous solution whose titer may range from 1 to 40 volumes, such as from 5 to 40 volumes, from 5 to 30 volumes, or from 5 to 20 volumes, for example. In certain embodiments, the oxidizing component is a 20V, 30V, or 40V hydrogen peroxide developer composition.

In one or more embodiments, the developer is a persulfate and/or a monopersulfate such as, for example, potassium persulfate, sodium persulfate, ammonium persulfate, as well as mixtures thereof. In one or more embodiments, the second liquid formulations are chosen from hydrogen peroxide, potassium persulfate, sodium persulfate, or mixtures thereof.

The developer may, in various embodiments, be present in a developer composition in an amount ranging from about 0.05% to about 50% by weight, such as from about 0.1% to about 30% by weight, from about 0.1% to about 20% by weight, about 1% to about 20%, about 1% to about 15%, about 1% to about 12%, about 3% to about 20%, about 3% to about 15%, about 3% to about 12%, about 5% to about 20%, about 5% to about 15%, about 5% to about 12%, about 7% to about 20%, about 7% to about 15%, about 7% to about 12%, about 9% to about 20%, about 9% to about 15%, or about 9% to about 12% by weight, based on the total weight of the developer composition.

The developer composition may contain, for example, at least one solvent, for example water, organic solvents, or mixtures thereof. Suitable organic solvents for use in the developer composition, alone or in mixture with water, include but are not limited to ethanol, isopropyl alcohol, propanol, benzyl alcohol, phenyl ethyl alcohol, glycols and glycol ethers, such as propylene glycol, hexylene glycol, ethylene glycol monomethyl, monoethyl or monobutyl ether, propylene glycol and its ethers, such as propylene glycol monomethyl ether, butylene glycol, dipropylene glycol, diethylene glycol alkyl ethers, such as diethylene glycol monoethyl ether and monobutyl ether, ethylene glycol, propylene glycol, butylene glycol, hexylene glycol, propane diol, glycerin, hydrocarbons such as straight chain hydrocarbons, mineral oil, polybutene, hydrogenated polyisobutene, hydrogenated polydecene, polydecene, squalane, petrolatum, isoparaffins, or mixtures thereof.

The organic solvents for use according to the developer compositions can be volatile or non-volatile compounds. The organic solvent may, for example, be present in an amount ranging from about 0.5% to about 70% by weight, such as from about 2% to about 60% by weight, such as from about 5 to about 50% by weight, relative to the total weight of the developer composition.

The developer compositions may optionally include other components typically used in developer compositions, such as, for example, rheology-modifying agents, chelants, fatty substances, ceramides, pH adjusting agents, preservatives, fragrances, surfactants, etc.

The developer composition may be, for example, in the form of a powder, gel, liquid, foam, lotion, cream, mousse, or emulsion. In a certain embodiment, the developer composition is aqueous and is in the form of a liquid, cream, or emulsion. In another embodiment, the developer composition is anhydrous or substantially anhydrous.

In an embodiment where the developer composition is liquid, e.g. aqueous, the developer composition may have a viscosity ranging from about 250 to about 2000 cps, such as, for example, from about 500 to about 2500 cps, about 500 to about 2000 cps, about 500 to about 1500 cps, about 600 to about 1300 cps, or about 650 to about 1200 cps when measured at 25 °C using a #4 spindle at 100 rpm.

As shown in FIGS. 1A and 1B, the formulation cartridge 100 has an elongate shape and dimensions configured for insertion into a handle of a formulation delivery device, in particular into a cartridge cavity of the handle. In an embodiment of a formulation delivery system, the elongate outer housing has a different construction between formulation cartridge 100 containing formulation and the cleaning cartridge, but with a common shape and dimensions. For example, in an embodiment, formulation cartridge 100 containing formulation have the construction of the partially recyclable embodiment shown in FIG. 1A and FIG. 1B, while the cleaning cartridge has similar shape and dimensions, but different materials and components.

Still referring to FIGS. 1A-3, the formulation cartridge 100 includes a plurality of liquid output nozzles 148, 150, which are sized and positioned at a distal (forward) end of the formulation cartridge 100 in a configuration that fluidically connects with a corresponding plurality of liquid inlets (e.g., first formulation inlets). In an embodiment, the liquid output nozzles include valves (such as primary valve 123 and tertiary valve 125, as discussed further herein with respect to FIG. 3 and FIG. 4) of formulation containers, vessels, etc., (e.g., pouches or packets) disposed in the formulation cartridge 100.

Figure 2:
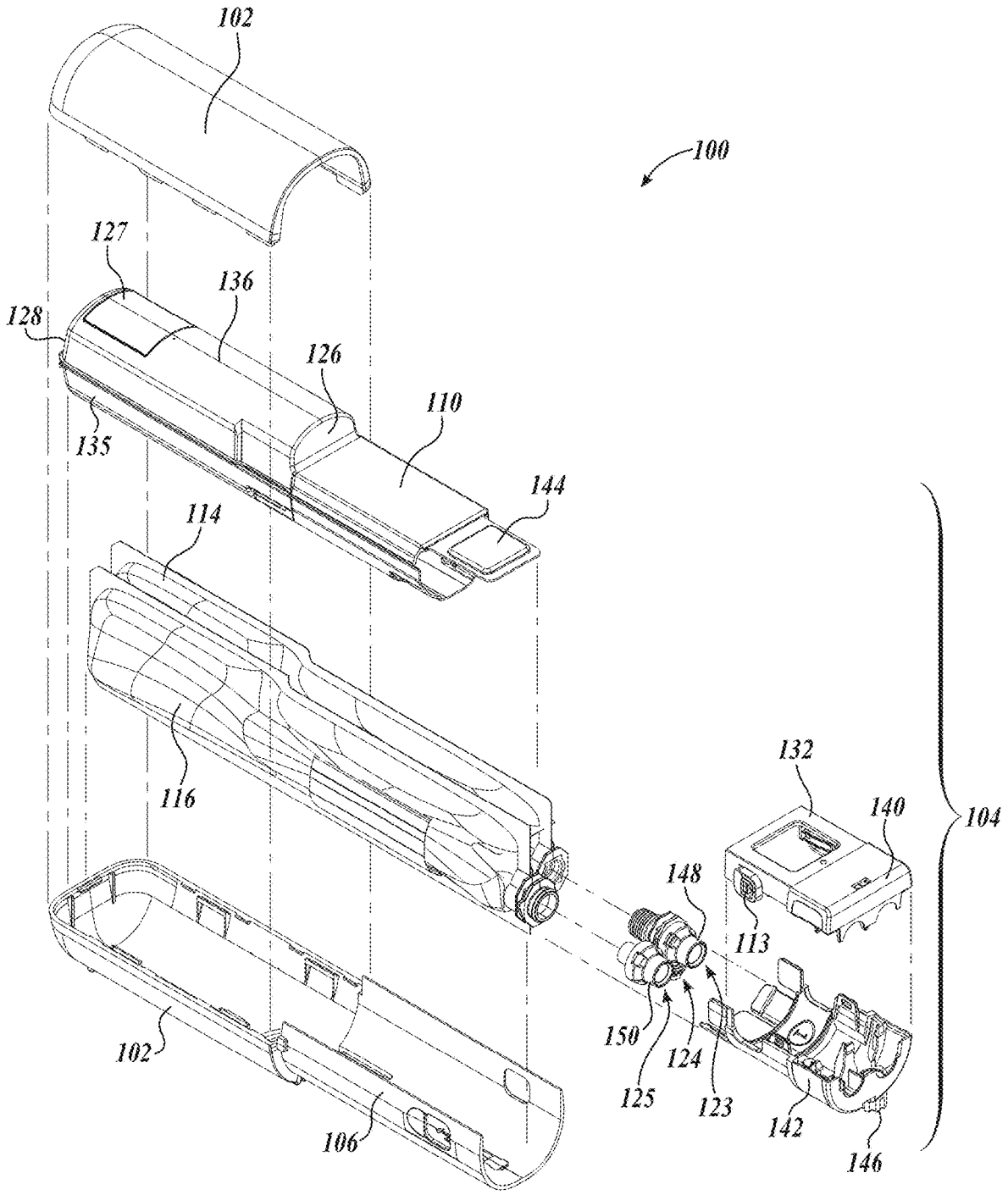
FIG. 2 is an exploded rear perspective view of the formulation cartridge of FIG. 1A.
Figure 3:
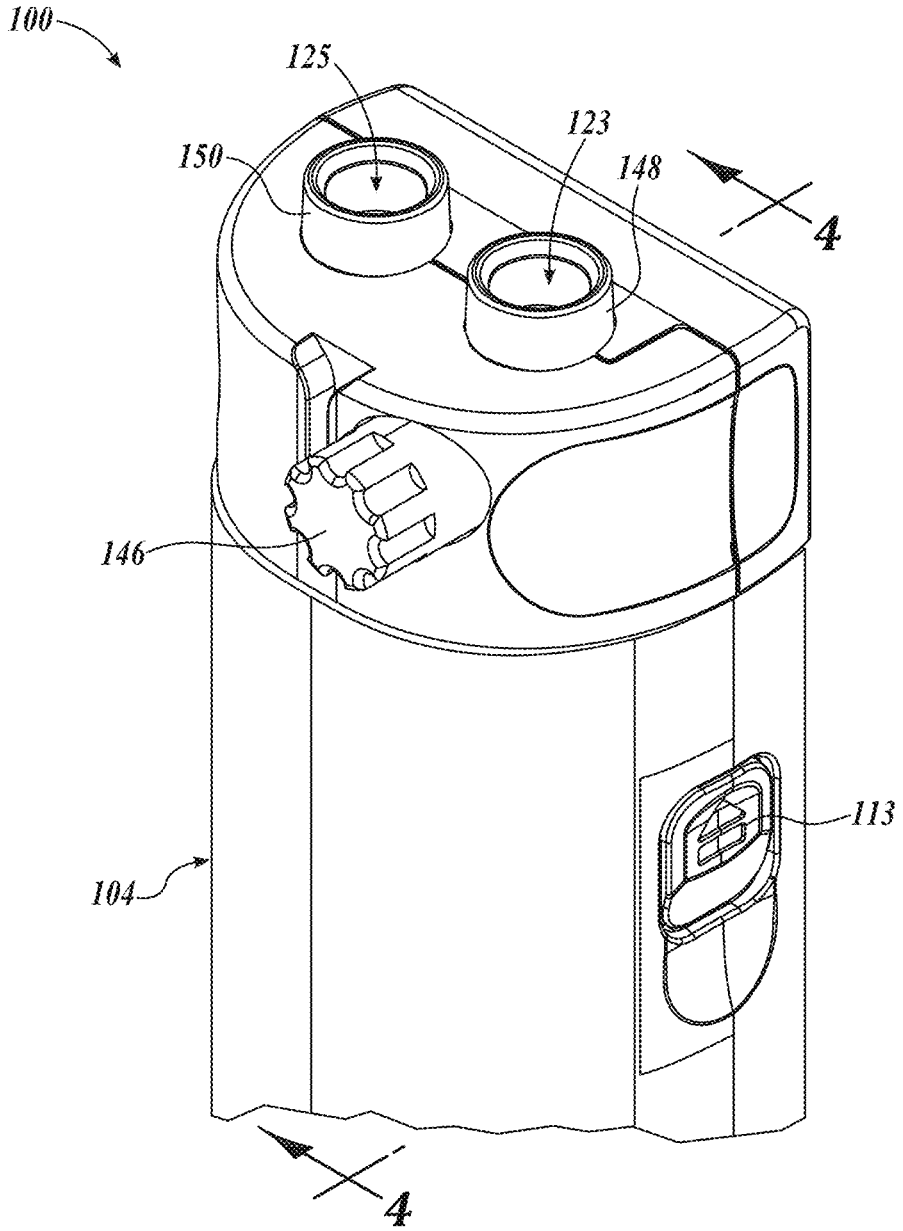
FIG. 3 is a top perspective view of a portion of the formulation cartridge of FIG. 1A.

Formulation cartridge 100 also includes a protective cap 146, best shown in FIG. 3, which couples to a gas output nozzle (hidden in FIGS. 1A-3). In an embodiment, the gas output nozzle is sized and positioned along the side of a distal (forward) end of the formulation cartridge 100 in a configuration that fluidically connects, for example, with a corresponding plurality of liquid inlets (e.g., first formulation inlets), such as the liquid inlets that fluidically connect with primary output nozzle 148 via primary valve 123. In an embodiment, the gas output nozzle includes a secondary valve 124 coupled to a formulation container or packet disposed in formulation cartridge 100. Primary valve 123 and examples of the secondary valve 124 are discussed further herein with respect to FIGS. 4-5 and 8-9.

A representative formulation cartridge 100, which is configured for insertion into a formulation delivery device and for storing a first formulation and a second formulation, is described in more detail below.

Referring now to FIG. 2, an exploded perspective view of an embodiment of a formulation cartridge 100 is depicted. Refill unit 104 of the formulation cartridge 100 generally includes a refill module comprising a shell 126 enclosing at least one formulation container or vessel. As used herein, "formulation container" refers to any container for a formulation, such as a fluid packet, a fluid pouch, a fluid tube, a fluid cartridge, or other fluid vessel. In the embodiment shown in FIG. 2, the refill module includes a first formulation container, referred to as first formula packet 114, and a second formulation container, referred to as second formula packet 116, and a valve frame 132 coupled with the refill module, e.g., a front body portion 110 of the shell 126. The first formula packet 114 and second formula packet 116 respectively contain a first formula fluid 118 and a second formula fluid 120. The fluids 118 and 120 are not shown in FIG. 2 for ease of illustration. The refill unit 104 may optionally include a packet sleeve.

Examples of first formula packet 114 and second formula packet 116 each have a volume of about 40 mL to about 70 mL, about 50 mL to about 60 mL, about 40 mL to about 65 mL, about 40 mL to about 60 mL, about 40 mL to about 55 mL, about 40 mL to about 50 mL, about 45 mL to about 70 mL, about 50 mL to about 70 mL, about 55 mL to about 70 mL, about 60 mL to about 70 mL, or about 55 mL. In an embodiment, first formula packet 114 and second formula packet 116 have different volumes. In an embodiment, refill unit 104 stores only a single formulation vessel.

The first formula fluid 118 and second formula fluid 120 can each be any of the formulations described herein, for example a permanent hair dye; semi-permanent hair dye; developer; conditioner; hair growth treatment, such as minoxidil; hair protein treatment; disulfide bond repairing hair treatment; fluid hair treatment; fluid scalp treatment, or the like, or other formulations. In an embodiment, the first formula fluid 118 and second formula fluid 120 differ. For example, in an embodiment, the first formula fluid 118 is a hair dye and the second formula fluid 120 is a developer. In another embodiment, the first formula fluid 118 and second formula fluid 120 are the same (e.g., a conditioner or scalp treatment formulation).

Each formula packet 114, 116 includes a formulation-containing packet and valve means for selectively-fluidic coupling the refill unit to a dispensing nozzle unit of a formulation delivery device when the formulation cartridge 100 is received within the hand-held formulation dispensing device. Representative valve means include valves 123, 125 (See FIG. 3) through which the formulation exits the formula packets 114, 116. Representative formulation containers, such as formula packets, are described in International Patent Application Publication No. 2019/067336A2, published Apr. 4, 2019, and assigned to L'Oreal S A, and U.S. Patent Application Publication No. 2021/0196021A1, published Jul. 1, 2021, and assigned to L'Oreal S A, both disclosures of which are hereby incorporated by reference in their entireties for all purposes.

Still referring to FIG. 2, the shell 126 has an elongate shape sized to be received within the reusable handle portion 102. Shell 126 encloses and protects the first formula packet 114 and second formula packet 116 and engages the valve frame 132 (described below). Thus, shell 126 functions, for example, as packaging which protects the formula packet 114, 116 during commerce prior to loading into the formulation delivery device.

In some embodiments, shell 126 has a total length between 150 mm and 250 mm (e.g., 175 mm-225 mm, 185 mm-215 mm, 195 mm-205 mm, or 200 mm) and a maximum cross-sectional dimension of 25 mm-50 mm (e.g., 30 mm-45 mm, 35 mm-40 mm, or 36 mm). Shell 126 has a rear body portion 128 and a slender front body portion 110, e.g., a neck portion, extending away from the rear body portion 128. The rear body portion 128 and the slender front body portion 110 generally align in a common longitudinal direction to enable assembly with the reusable handle portion 102, and to enable insertion into the cartridge cavity of the formulation delivery device. In an embodiment, shell 126 is constructed at least partially from a recyclable or recycled material, e.g., a paper material such as an injection-molded paper material or a die-cut structured paper (e.g., cardboard). In the illustrated embodiment, the shell 126 is formed from a single piece of injection-molded paper material. In an embodiment in which the shell 126 is formed of paper, the paper has a weight between 8-12 points (e.g., 8.5 points, 9.0 points, 9.5 points, 10.0 points, 10.5 points, 11.0 points, or 11.5 points), to impart sufficient stiffness without contributing excess disposable material.

The rear body portion 128 of the shell 126 has a larger cross-sectional dimension than the front body portion 110 when viewed in a plane normal to the longitudinal direction of the formulation cartridge 100. A hump or bulge imparts the larger cross-sectional area of the rear body portion 128 relative to the slender front body portion 110. Advantageously, the hump or bulge enables the use of higher-volume formula packets 114, 116. Additionally, the hump or bulge forms an abutment which abuts a corresponding interior face of the handle portion 102 and secures the longitudinal position of the shell 126 during use.

The slender front body portion 110 of the shell 126 is sized to fit within the tray portion 106 of the handle portion 102 and to project into the cartridge cavity of the formulation delivery device during use. As shown in FIG. 1B, the front body portion 110 couples with the valve frame 132. To facilitate secure connection and alignment with the valve frame 132, front body portion 110 includes valve frame coupling means, for example at least one coupling tab 144 configured to selectively engage the valve frame 132. In the illustrated embodiment, the front body portion 110 includes a single coupling tab 144 extending away from a front end thereof. The coupling tab 144 includes an engagement feature, for example a detent or raised prominence shaped and sized to engage a complementary aperture of the valve frame 132.

Shell 126 may have many different configurations. For example, referring to FIG. 2, the illustrated shell 126 is a clamshell configuration formed with at least two partial shells (in this embodiment, a first half 135 and a second half 136) hingedly coupled. In some embodiments, the shell 126 includes a different number of partial shells, e.g., three or four partial shells which come together to enclose the formulation packets 114, 116. In still other embodiments, shell 126 comprises a single piece forming an open-ended tube into which the formulation packets 114, 116 may be inserted. Alignment of the first half 135 and second half 136 enables correct attachment of the front body portion 110 to the valve frame 132.

While the illustrated shell 126 is formed of an injection molded paper material, this construction is representative, not limiting. In some embodiments, shell 126 is formed of a single piece of die-cut paper stock, which is folded to impart a three-dimensional structure having the 128 and slender front body portion 110 extending away therefrom. In some such embodiments, this folded construction creates a polygonal cross section in the rear body portion 128 and a polygonal cross section in the front body portion 110 (for example, octagonal and hexagonal cross sections, respectively). To facilitate assembly, some such embodiments of the shell 126 include one or more scores or guidelines that ensure correct folding. Some embodiments have a triangular, rectangular, pentagonal, hexagonal, heptagonal, octagonal, or other polygonal cross-sectional shape.

Valve frame 132 provides a rigid structure which aligns the formulation packet valves 123, 125 for correct fluid interconnection with the fluid conduits of the formulation delivery device. Additionally, in some embodiments, valve frame 132 supports an optional encryption chip 138 as described above. In such embodiments, valve frame 132 is sized and shaped to accurately position the encryption chip 138 adjacent to the cartridge authentication interface of the formulation delivery device when the formulation cartridge 100 is disposed in the handle of the formulation delivery device. Accordingly, valve frame 132 is formed from ABS plastic, HDPE, or other rigid polymer or other material. In some embodiments, valve frame 132 is formed from a same material as shell 126.

A plurality of valve engagement units 140 extend through a front end of the valve frame 132. Each valve engagement unit 140 receives and secures one of the formulation packet valves 148, 150. In some embodiments, the valve engagement unit 140 is a valve aperture or cutout disposed through a face of the valve frame 132, the valve aperture or cutout being sized to receive a valve of a formulation packet and optionally to engage an outer circumference of the valve. To enable coupling with the shell 126, valve frame 132 includes optional engagement members 142 (e.g., tabs) extending therefrom. In some embodiments, valve frame 132 engages with the front body portion 110 by a friction fit.

An optional encryption chip 138 (e.g., an RFID tag) is disposed on the refill unit 104, e.g., on the shell 126 or on the valve frame 132 (as in the illustrated embodiment). The encryption chip 138 is positioned on the refill unit 104 such that when the formulation cartridge 100 is inserted into the formulation delivery device, it is positioned to be read by the cartridge authentication interface thereof. Accordingly, the encryption chip 138 stores information about the formulation cartridge 100 and its contents, for example at least one of a formulation identification, a beginning formulation quantity, a formulation expiration date, or a formulation production date.

Thus, the shell 126, formula packets 114, 116 and valve frame 132 form the refill unit 104. In use, refill unit 104 is reversibly (e.g., detachably) couplable with handle portion 102, e.g., by securing means such as coupling tabs on the shell 126 or by friction fit between the refill unit 104 and the handle portion 102.

Figure 4:
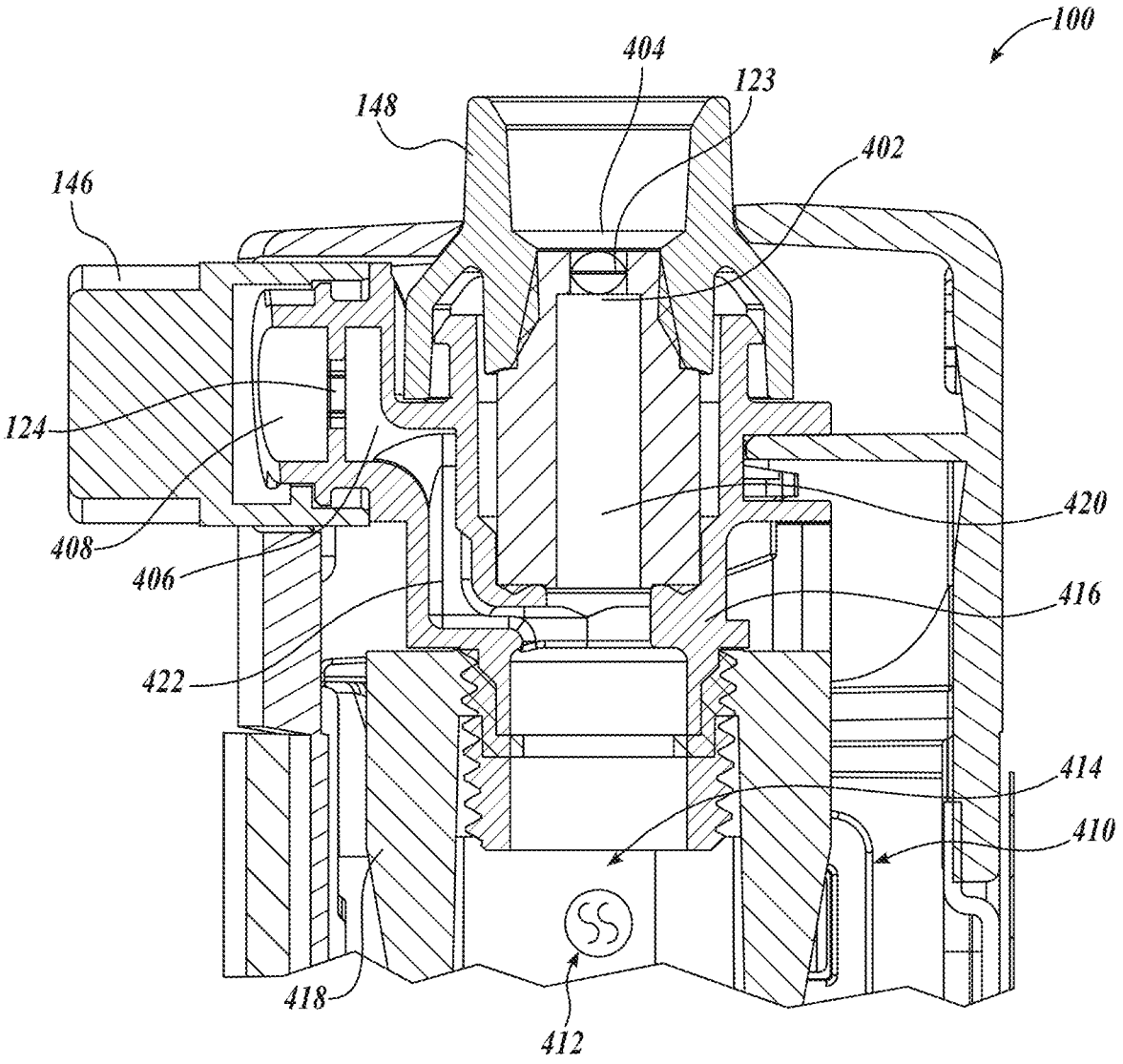
FIG. 4 is a cross-sectional view of the formulation cartridge depicted in FIG. 3 taken along lines 4-4.
Figure 5:
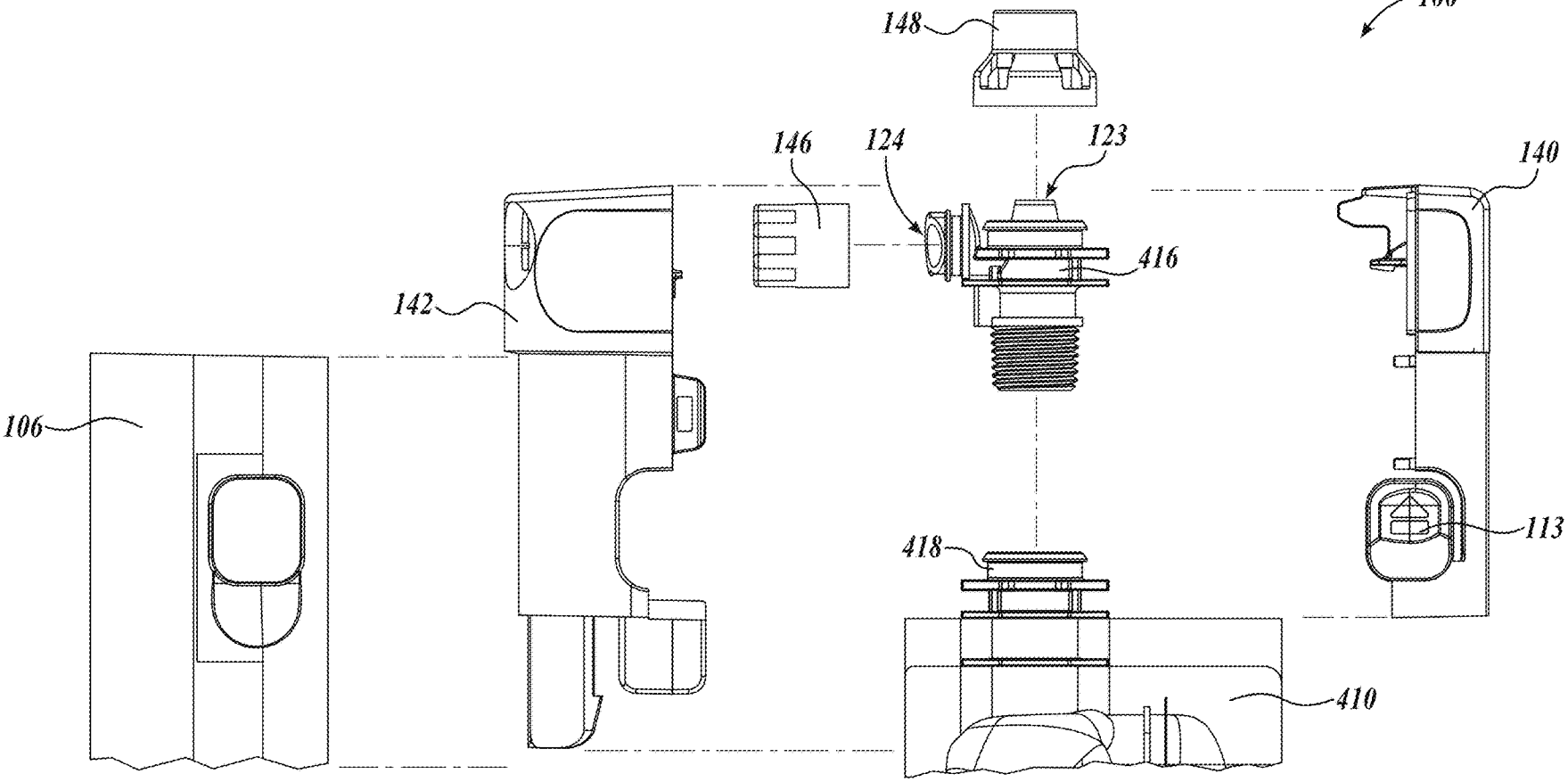
FIG. 5 is an exploded side view of a portion of the formulation cartridge of FIG. 3.
Figure 6:
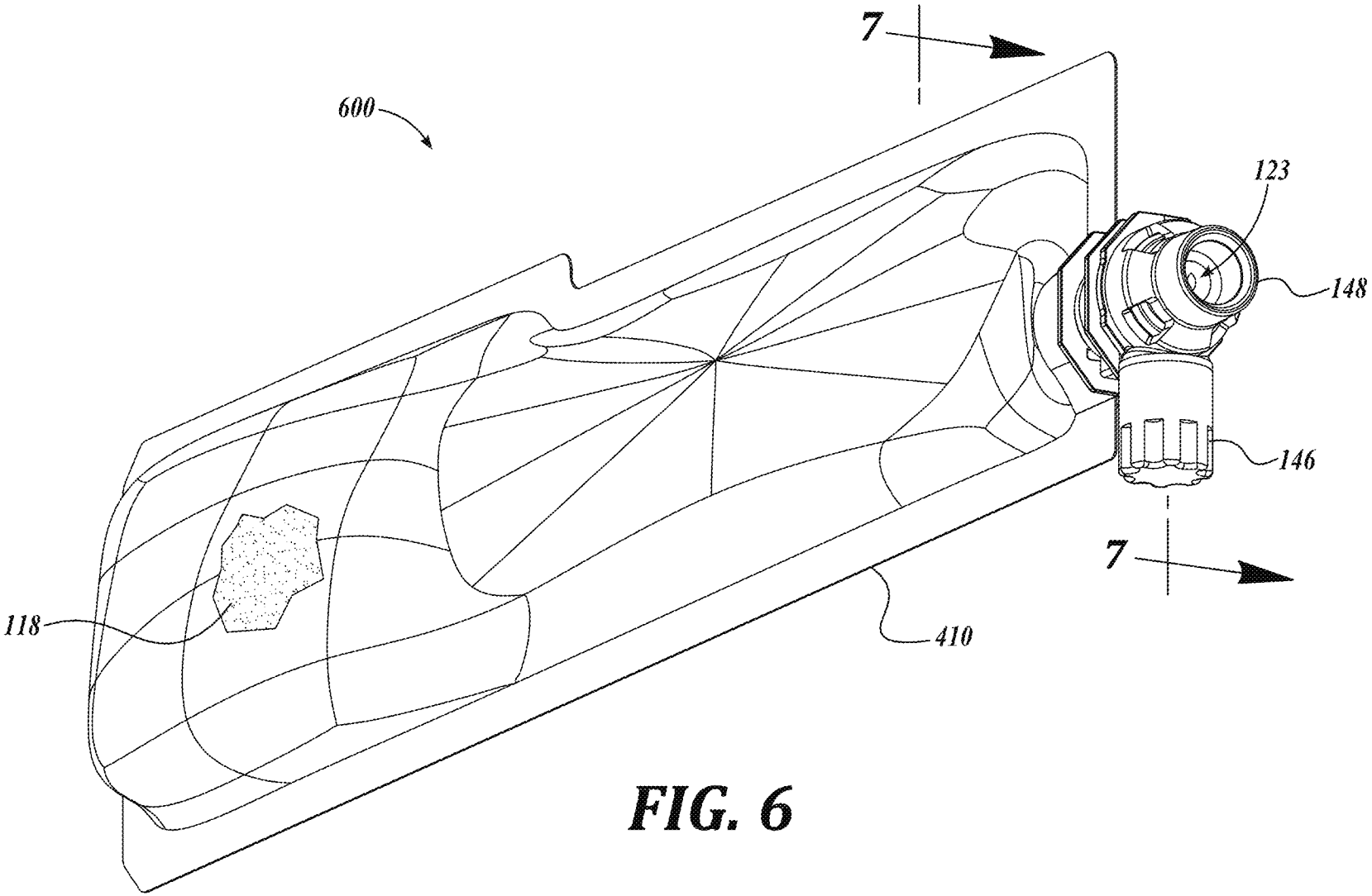
FIG. 6 is a front perspective view of an example of a formula container assembly according to one or more aspects of the present disclosure, the formula container assembly suitable for use in the formulation cartridge of FIG. 1.
Figure 7:
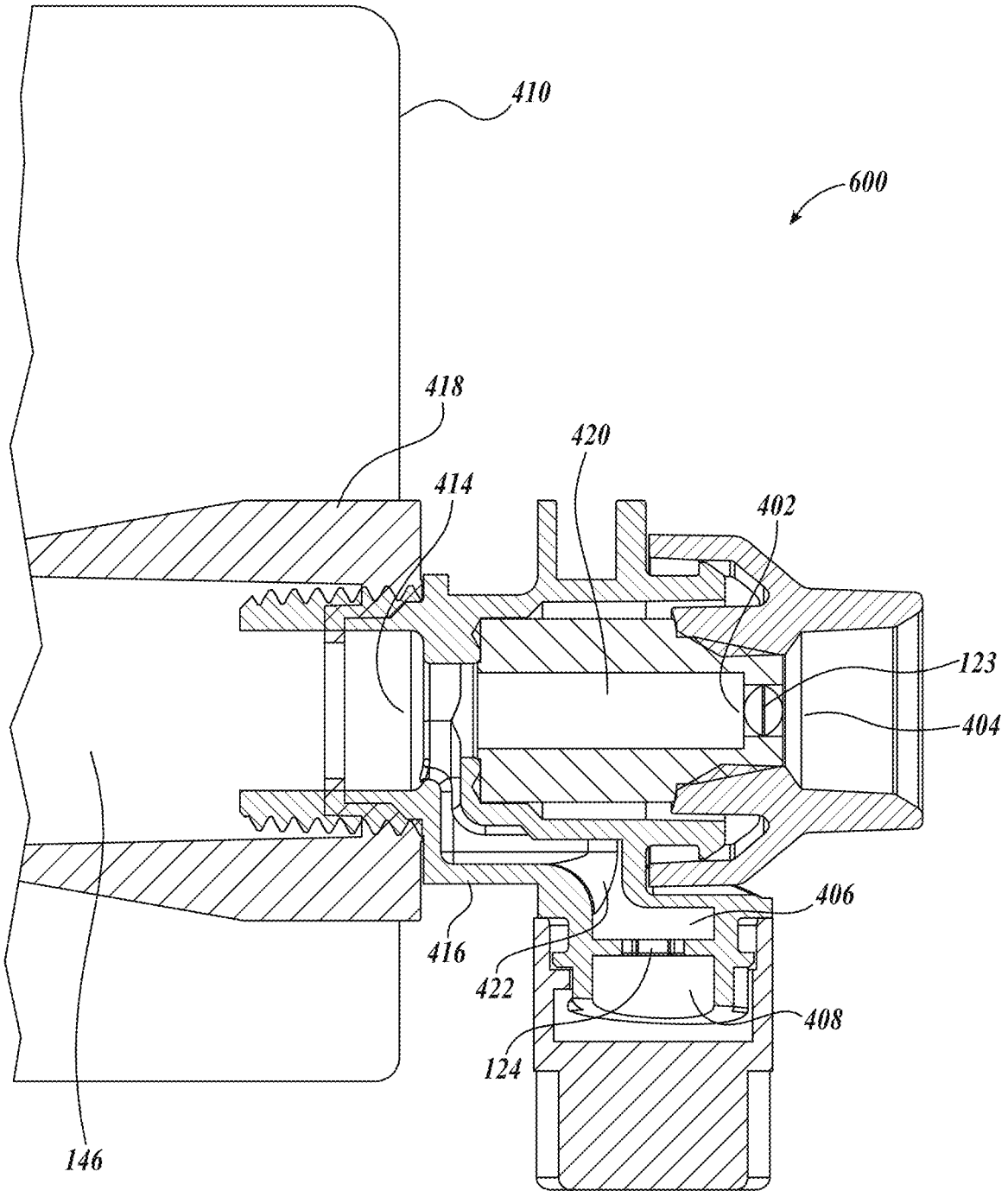
FIG. 7 is cross-sectional view of the formula container assembly of FIG. 6, taken along lines 7-7 of FIG. 6.

Turning to FIGS. 4-5, a cross-sectional and exploded side view of the formulation cartridge 100 of FIG. 3 is depicted, respectively, and to FIGS. 6-7, a formula packet assembly 600 is depicted. In FIGS. 4 and 5, formulation cartridge 100 is shown to contain the formula packet 410, the primary valve 123, the secondary valve 124, and the protective cap 146. Formula packet assembly 600 is shown in FIGS. 6-7 to include formula packet 410 and valve assembly 416. Each of these components will now be explained in greater detail.

Formula packet 410 includes a packet chamber 412 and a packet outlet 414. As depicted in FIG. 4, packet chamber 412 includes a formula fluid, such as first formula fluid 118 or second formula fluid 120 described further herein above with respect to FIG. 2. The formula fluid can be a non-gaseous formula fluid, a gaseous formula fluid, or a combination thereof. In some embodiments, the non-gaseous formula fluid undergoes off-gassing while sealed within the packet chamber 412, thereby generating gaseous formula fluid. Without being bound by theory, when the formula fluid comprises a developer, such as any of the developer formulations discussed further herein above with respect to FIG. 2, the developer can contain chemical compositions which oxidize during transportation and storage. Such compositions will off-gas until the vapor pressure of gaseous formula fluid is equivalent to the equilibrium vapor pressure of the non-gaseous formula fluid.

In an embodiment, the formula packet 410 can be, for example, a flexible formula packet constructed from a flexible material, thereby allowing the formula packet 410 to adjust to accommodate any gaseous formula fluid produced via off-gassing.

The packet outlet 414 is positioned towards the distal (forward) end of formulation cartridge 100. A valve assembly 416 is configured to fluidically couple with the packet outlet 414, thereby providing one or more passages for formula fluid flowing out of the packet chamber 412. In some embodiments, an insert structure, such as container gripping insert 418, is inserted into and coupled to packet outlet 414, thereby providing a secure base by which valve assembly 416 can be coupled to the packet outlet 414.

In an embodiment, container gripping insert 418 can be configured to securely receive the valve assembly 416, such as via a snap fit mechanism, a screw fit mechanism, and the like. However, it is to be understood that valve assembly 416 can also be coupled directly to packet outlet 414. Container gripping insert 418 can also extend into packet chamber 412 via rigid arms, such as those depicted in FIG. 7. Such rigid arms can provide internal structure to the formula packet by holding apart a first and second wall of packet chamber 412, thereby maintaining an open flow path as fluid is evacuated from packet chamber 412.

In the embodiment of FIGS. 4-5, valve assembly 416 is shown to contain both primary valve 123 and secondary valve 124. As shown in FIG. 4, primary valve 123 has a primary valve inlet 402 and a primary valve outlet 404, and secondary valve 124 has a secondary valve inlet 406 and a secondary valve outlet 408. Both primary valve inlets 402 and 406 are in fluid communication with the packet chamber 412. In some embodiments, primary valve inlet 402 and secondary valve inlet 406 are substantially adjacent to one another, such that both primary valve 123 and secondary valve 124 directly connect with packet chamber 412 at the same location. In some embodiments, the primary valve inlet 402 of primary valve 123 is located at a terminal end of primary flow channel 420, and the secondary valve inlet 406 of the secondary valve 124 is located at a terminal end of secondary flow channel 422, such that primary flow channel 420 and secondary flow channel 422 connect with packet chamber 412 at substantially the same location. However, it is to be understood that primary flow channel 420 and secondary flow channel 422 can take any suitable path to connect to packet chamber 412 and need not be co-terminal with one another.

In an embodiment, primary valve 123 and secondary valve 124 at their respective inlets 402, 406, are exposed to the same pressure as packet chamber 412. In another embodiment, primary valve 123 and/or secondary valve 124 at their respective inlets 402, 406, are exposed to a different pressure as packet chamber 412.

In some embodiments, such as is depicted in FIG. 7, an inner diameter of primary flow channel 420 is greater in magnitude than an inner diameter of secondary flow channel 422. In some embodiments, primary flow channel 420 defines a substantially straight fluid pathway from the packet chamber 412 to the primary valve 123. In some embodiments, secondary flow channel 422 defines a curved or multi-directional fluid pathway from the fluid packet chamber 412 to the secondary valve 124, such as by tracing an external edge of primary flow channel 420 to emerge perpendicular to the flow path of primary flow channel 420, as illustrated in FIG. 4. Without being bound by theory, such a configuration is advantageous because a non-straight flow path prevents incidental splashing of the non-gaseous fluid from blocking or interfering with the function of secondary valve 124. Additionally, the narrower secondary flow channel 422 provides an effective flow path for a gaseous fluid, while the broader primary flow channel 420 provides an effective flow path for a non-gaseous fluid.

Any suitable valve configuration of the one-way type can be practiced in embodiments of the present disclosure for carrying out the functionality of the primary valve 123 and the secondary valve 124. In an embodiment, each of the primary valve 123 and the secondary valve 124 are of the type having a cracking pressure. As used herein, a cracking pressure is the pressure differential between the inlet and outlet ports of a valve that must be exceeded before the valve first starts to flow. Valves having a cracking pressure generally include check valves, and can include, but are not limited to, swing-type check valves, poppet-type check valves, spring-loaded ball-type check valves, duckbill-type valves, butterfly-type valves, tilting disc-type valves, wafer-type check valves, lift-type valves, umbrella valves, diaphragm check valves, etc., all of which can be practiced with embodiments of the present disclosure. In a certain embodiment, the secondary valve 124 is an umbrella valve. In another certain embodiment, both the primary valve 123 and the secondary valve 124 are umbrella valves.

Generally stated, primary valve 123 is configured to allow flow of non-gaseous formula fluid, whereas secondary valve 124 is configured to allow flow of gaseous formula fluid as an initial purge of gas buildup before the non-gaseous formula fluid flows through the primary valve 123. Accordingly, the cracking pressure of secondary valve 124 is lower than that of primary valve 123.

In some embodiments, the cracking pressure is selected so as to allow release of gas anytime the pressure of gaseous formula fluid exceeds a filling pressure of gaseous formula fluid. In some embodiments, a user can apply pressure to the walls of the formula packet 410, thereby increasing the internal pressure experienced by secondary valve 124. When the pressure applied by a user and the pressure exerted by the gaseous formula fluid exceed the cracking pressure, gaseous formula fluid can be released through secondary valve 124.

In some embodiments, this purging process is performed once before the formula packet assembly 600 is used in a formulation delivery system. In some embodiments, this purging process can be repeated two or more times to purge additional volumes of gaseous formula fluid. In some embodiments, pressure can be applied until non-gaseous formula fluid flows from the secondary valve 124, thereby indicating the gaseous formula fluid has been evacuated from the formula packet 410. In some embodiments, a spring-based mechanism can be tailored to provide an indication to the user when enough force has been applied to expel a particular volume of gaseous formula fluid, such as by providing an auditory signal that a sufficient force has been achieved. In some embodiments, the formula packet 410 is pre-filled with a headspace pressure of an inert gas, such as nitrogen or argon gas, thereby increasing the headspace pressure, and thus decreasing the amount of exerted pressure the user must apply before exceeding the cracking pressure of secondary valve 124.

In some embodiments, the cracking pressure of secondary valve 124 is considerably lower than primary valve 123. In some embodiments, the cracking pressure of the secondary valve 124 is in a range of 0.2 to 5 psi. In some embodiments, the cracking pressure of the secondary valve 124 is in a range of 0.2 to 4 psi. In some embodiments, the cracking pressure of the secondary valve 124 is in a range of 2 to 4 psi. In some embodiments, the cracking pressure of the secondary valve 124 is in a range of 3 to 4 psi.

In some embodiments, the cracking pressure of secondary valve 124 is selected to prevent cracking of the secondary valve 124 during transit of the formula packet assembly 600, such as due to inversion of the formula packet assembly 600, or due to external air pressure differentials experienced such as when shipping to locations with higher elevation or during transport via air freight. For example, the cracking pressure can be sufficiently high so as to prevent cracking due to the latent liquid formula fluid pressure of an inverted formula packet assembly 600. The cracking pressure can also be sufficiently high so as to prevent cracking due to the external air pressure dropping due to transport in a non-pressure-controlled compartment of a cargo jet airplane. In some embodiments, protective cap 146 can be coupled to the formula packet assembly 600 to provide additional protection against accidental leakage, while still maintaining a suitably low cracking pressure. Accordingly, protective cap 146 can be coupled to formula packet assembly 600 via a press fit mechanism, a screw-lock mechanism, or the like.

In some embodiments, secondary valve 124 is coupled with a pull tab. In these embodiments, when a user applies force on the pull tab, such as by twisting and/or pulling on the pull tab, the force creates a vacuum with respect to the interior of the formula packet 410, thereby drawing gaseous formula fluid out through secondary valve 124.

In some embodiments, the sealed fluid container, such as first formula packet 114, is installed in formulation cartridge 100 with the protective cap 146 still removed. In some embodiments, the formula packet 114 cooperates with the formulation cartridge 100 in such a manner that, when the cartridge 100 is inserted in an associated formulation system, such as the system described with respect to FIG. 1A-3, a user is unable to apply pressure to formula packet 114 once it is installed in formulation cartridge 100, thereby preventing the user from imparting a positive pressure on the formula packet 114. As such, the secondary valve 124 stays sealed when formulation cartridge 100 is in use by a user. Thus, the installation of formula packet 114 prevents accidental purging by a user.

In some embodiments, when formula is drawn through a primary valve, such as primary valve 123, negative pressure is exerted on the sealed fluid container, such as first formulation packet 114. This negative pressure helps secondary valve 124 remain sealed during operation, thus providing additional security against accidental purging by the user. In some embodiments, formula is drawn through primary valve 123 by a pump, such as by a peristaltic pump, thereby exerting negative pressure on the sealed fluid container. In some embodiments, secondary valve 124 is an umbrella valve, and the negative pressure on first formulation packet 114 pulls the umbrella valve into its sealing position (e.g., against the valve seat of the secondary valve).

Figure 8:
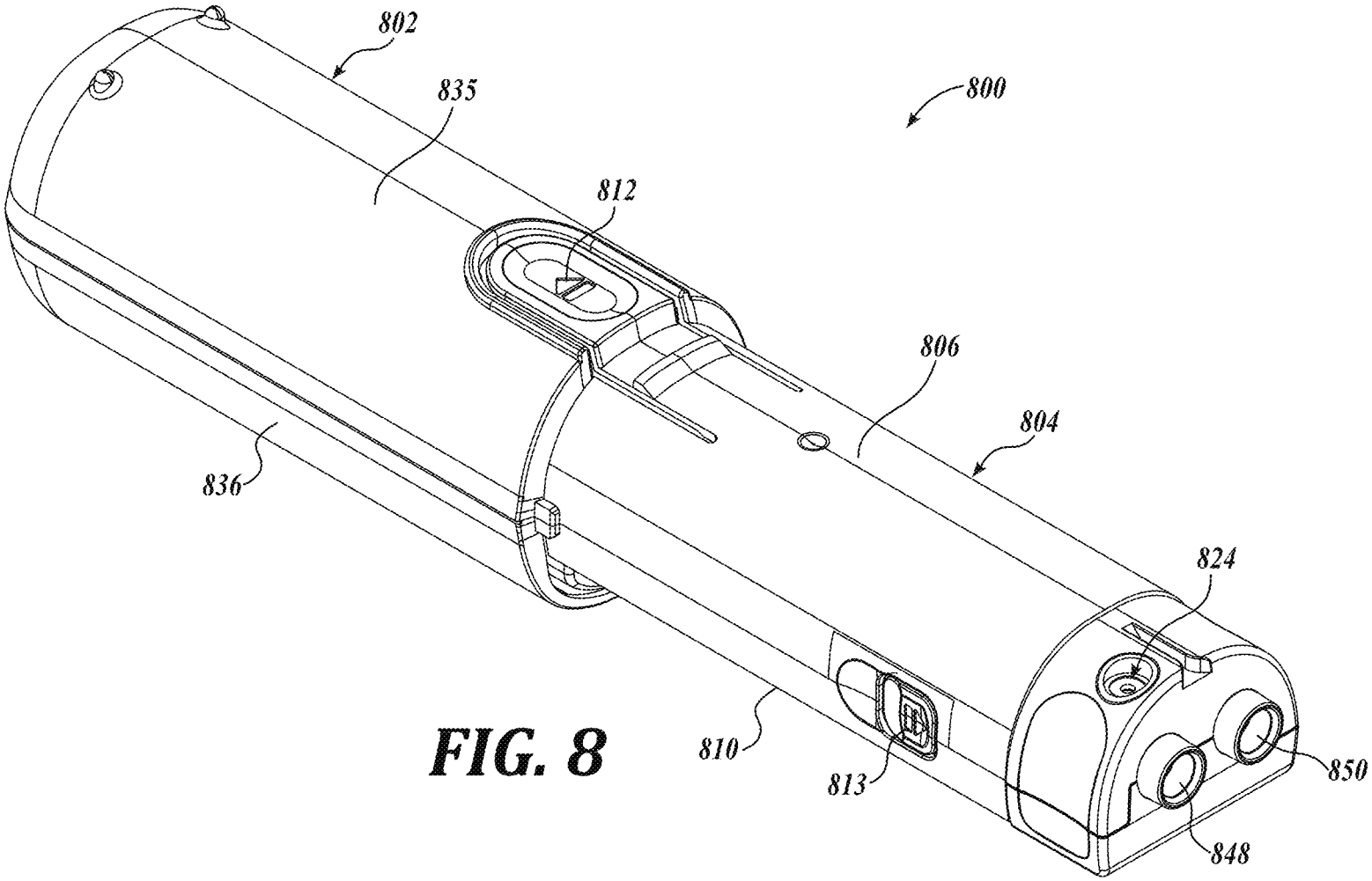
FIG. 8 is a front perspective view of another example of a formulation cartridge according to one or more aspects of the present disclosure.
Figure 9:
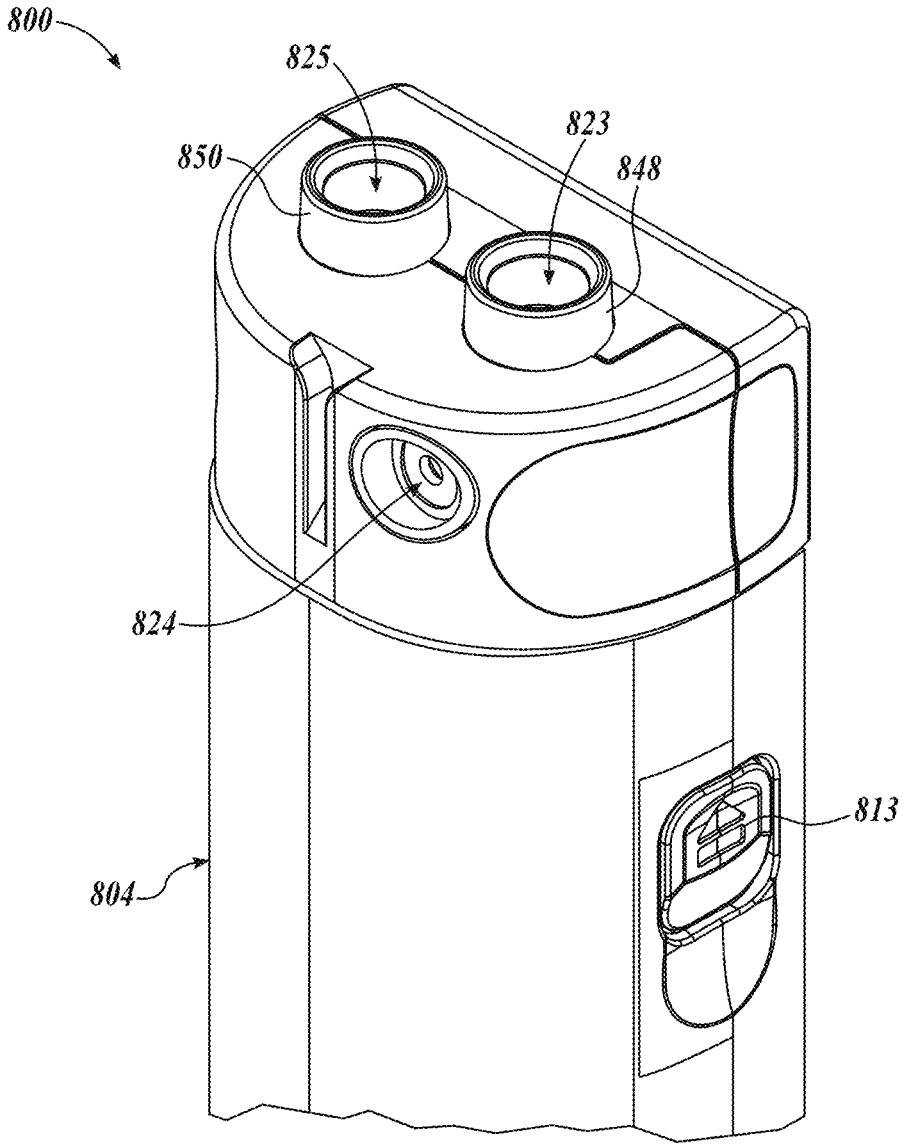
FIG. 9 is a top perspective view of a portion of the formulation cartridge of FIG. 8.

A second embodiment of formulation cartridge 800 will now be described with reference to FIGS. 8 and 9. The formulation cartridge 800 is substantially identical to the formulation cartridge 100, with the exception that the secondary valve 824 of the formulation cartridge 800 differs from the secondary valve 124 of the formulation cartridge 100. Thus, parts of the formulation cartridge 800 will be labeled with identical part numbers as the formulation cartridge 100 except in the '800 series. Moreover, only the secondary valve 824 and how it impacts the function of formulation cartridge 800 will be described in detail.

Formulation cartridge 800 is shown to be directly exposed to an external environment without the use of a protective cap, such as protective cap 146. Such a configuration has the advantage of not requiring a disposable component for a user and provides a more streamlined external form factor. Such an embodiment can provide advantages for manufacture, particularly in cases where secondary valve 824 is provided with a sufficiently high cracking pressure to avoid accidental leakage during transit and storage, such as in the embodiments discussed further herein above with respect to FIGS. 6-7.

Additionally, a formulation cartridge 800 without at protective cap 146 can have a more streamlined form factor, thus preventing accidental bumping or damage to the formulation cartridge 800 during transit or handling by a user.

The detailed description set forth above in connection with the appended drawings, where like numerals reference like elements, are intended as a description of various embodiments of the present disclosure and are not intended to represent the only embodiments. Each embodiment described in this disclosure is provided as a representative example or illustration and should not be construed as preferred or advantageous over other embodiments. The representative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification. That is, the present disclosure includes embodiments that combine features from different embodiments.

In the foregoing description, specific details are set forth to provide a thorough understanding of example embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

In the detailed description herein, references to "one embodiment", "an embodiment", "an example embodiment", "one or more embodiments", "some embodiments", various embodiments", etc., indicate that the embodiment or embodiments described may include a particular feature, structure, or characteristic, but every embodiment may not necessarily include the particular feature, structure, or characteristic. Moreover, such phrases are not necessarily referring to the same embodiment or embodiments. In addition, when a particular feature, structure, or characteristic is described in connection with an embodiment or embodiments, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Thus, it will be appreciated that embodiments of the present disclosure may employ any combination of features described herein. All such combinations or sub-combinations of features are within the scope of the present disclosure.

Throughout this specification, terms of art may be used. These terms are to take on their ordinary meaning in the art from which they come, unless specifically defined herein or the context of their use would clearly suggest otherwise.

The drawings in the FIGURES are not to scale. Similar elements are generally denoted by similar references in the FIGURES. For the purposes of this disclosure, the same or similar elements may bear the same references. Furthermore, the presence of reference numbers or letters in the drawings cannot be considered limiting, even when such numbers or letters are indicated in the claims.

In the claims and for purposes of the present disclosure, the terms "a", "an", "the", and the like, refer to the singular and the plural forms of the object or element referenced.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

Non-Limiting Embodiments

While general features of the disclosure are described and shown and particular features of the disclosure are set forth in the claims, the following non-limiting embodiments relate to features, and combinations of features, that are explicitly envisioned as being part of the disclosure. The following non-limiting embodiments contain elements that are modular and can be combined with each other in any number, order, or combination to form a new non-limiting embodiment, which can itself be further combined with other non-limiting embodiments.

Embodiment 1. A formula container assembly comprising: a formula container comprising a container chamber and a container outlet; a primary valve comprising a primary valve inlet and a primary valve outlet; and a secondary valve comprising a secondary valve inlet and a secondary valve outlet, wherein the primary valve inlet and the secondary valve inlet are in fluid communication with the container chamber.

Embodiment 2. The formula container assembly of Embodiment 1, wherein the formula container is a flexible formula container.

Embodiment 3. The formula container assembly of any of Embodiments 1 or 2, wherein the container chamber comprises a formula fluid, the formula fluid comprising a liquid formula fluid and a gaseous formula fluid.

Embodiment 4. The formula container assembly of any of Embodiments 1-3, wherein the formula fluid off-gasses the gaseous formula fluid.

Embodiment 5. The formula container assembly of any of Embodiments 1-4, further comprising a valve assembly, the valve assembly comprising the primary valve and the secondary valve.

Embodiment 6. The formula container assembly of any of Embodiments 1-5, further comprising a container gripping insert configured to nest in the container outlet and receive the valve assembly.

Embodiment 7. The formula container assembly of any of Embodiments 1-6, further comprising a primary flow channel comprising a primary flow inlet and a secondary flow channel comprising a secondary flow inlet.

Embodiment 8. The formula container assembly of any of Embodiments 1-7, wherein the primary flow inlet and the secondary flow inlet are both coterminal with an interior portion of the container gripping insert.

Embodiment 9. The formula container assembly of any of Embodiments 1-8, wherein an inner diameter of the primary flow channel is greater than an inner diameter of the secondary flow channel.

Embodiment 10. The formula container assembly of any of Embodiments 1-9, wherein the secondary valve is configured to open when a fluid pressure in the secondary valve inlet relative to an exterior air pressure exceeds a cracking pressure.

Embodiment 11. The formula container assembly of any of Embodiments 1-10, wherein, when pressure is applied to the formula container, the fluid pressure in the secondary flow channel increases and opens the secondary valve, thereby allowing the gaseous formula fluid to be purged from the formula container through the secondary valve outlet.

Embodiment 12. The formula container assembly of any of Embodiments 1-11, wherein the cracking pressure exceeds a latent liquid formula fluid pressure when the formula container assembly is held upside down, thereby preventing the leakage of formula from the formula container assembly.

Embodiment 13. The formula container assembly of any of Embodiments 1-12, wherein the cracking pressure is in a range of about 0.2 psi to about 5 psi.

Embodiment 14. The formula container assembly of any of Embodiments 1-13, wherein the secondary valve is an umbrella valve.

Embodiment 15. The formula container assembly of any of Embodiments 1-14, further comprising a protective cap configured to removably seal an exterior of the secondary valve outlet.

While illustrative embodiments have been illustrated and described, it will be appreciated that various changes can be made therein without departing from the spirit and scope of the invention.

The embodiments of the invention in which an exclusive property or privilege is claimed are defined as follows:

1. A formula container assembly comprising:

a formula container comprising a container chamber and a container outlet;

a primary valve comprising a primary valve inlet and a primary valve outlet; and a secondary valve comprising a secondary valve inlet and a secondary valve outlet;

a valve assembly comprising the primary valve and the secondary valve; and a container gripping insert configured to nest in the container outlet and receive the valve assembly, wherein the primary valve inlet and the secondary valve inlet are in fluid communication with the container chamber.

2. The formula container assembly of claim 1, wherein the formula container is a flexible formula packet.

3. The formula container assembly of claim 1, wherein the container chamber comprises a formula fluid, the formula fluid comprising a liquid formula fluid and a gaseous formula fluid.

4. The formula container assembly of claim 3, wherein the formula fluid off-gasses the gaseous formula fluid.

5. The formula container assembly of claim 1, further comprising a primary flow channel comprising a primary flow inlet and a secondary flow channel comprising a secondary flow inlet.

6. The formula container assembly of claim 5, wherein the primary flow inlet and the secondary flow inlet are both coterminal with an interior portion of the container gripping insert.

7. The formula container assembly of claim 5, wherein an inner diameter of the primary flow channel is greater than an inner diameter of the secondary flow channel.

8. The formula container assembly of claim 1, wherein the secondary valve is configured to open when a fluid pressure in the secondary valve inlet relative to an exterior air pressure exceeds a cracking pressure.

9. The formula container assembly of claim 8, wherein, when pressure is applied to the formula container, the fluid pressure in the secondary flow channel increases and opens the secondary valve, thereby allowing the gaseous formula fluid to be purged from the formula container through the secondary valve outlet.

10. The formula container assembly of claim 8, wherein the cracking pressure exceeds a latent liquid formula fluid pressure when the formula container assembly is held upside down, thereby preventing the leakage of formula from the formula container assembly.

11. The formula container assembly of claim 8, wherein the cracking pressure is in a range of about 0.2 psi to about 5 psi.

12. The formula container of claim 1, wherein the secondary valve is an umbrella valve.

13. The formula container assembly of claim 1, further comprising a protective cap configured to removably seal an exterior of the secondary valve outlet.

* * * * *